US005823812A

United States Patent [19]

Bhargava et al.

[11] Patent Number: 5,823,812

[45] Date of Patent: Oct. 20, 1998

[54] ELECTRICAL CONNECTOR

[75] Inventors: Vikram Bhargava, Coram; Timothy Kehoe, Smithtown; Daniela Stratienco, Sound Beach, all of N.Y.

[73] Assignee: Symbol Technologies, Inc., Holtsville, N.Y.

[21] Appl. No.: 693,981

[22] Filed: Aug. 8, 1996

[51] Int. Cl.[6] ..... H01R 4/50

[52] U.S. Cl. ..... 439/345; 439/953

[58] Field of Search ..... 439/953, 362, 439/364, 365, 345, 346

[56] References Cited

U.S. PATENT DOCUMENTS

| | | | |
|---|---|---|---|
| 1,978,076 | 10/1934 | Cassedy, Jr. | 439/953 |
| 4,709,975 | 12/1987 | Williams, II | 439/953 |
| 5,091,991 | 2/1992 | Briggs et al. | 439/953 |
| 5,109,453 | 4/1992 | Edwards et al. | 439/953 |
| 5,647,758 | 7/1997 | Ichikawa et al. | 439/953 |

*Primary Examiner*—Hien Vu
*Attorney, Agent, or Firm*—Kirschstein et al.

[57] ABSTRACT

An electrical coupling arrangement, particular for digital transfer, has a female connector and a male connector. Each connector has an electrical coupling portion via which the data are transferred. The connectors are held together by means of a latching arrangement consisting of a pair of fixed latching posts on the male connector which mate with a corresponding pair of flexible latching sleeves which are molded within the body of the female connector. The self-latching action means that the coupling may be effected rapidly but also securely. The invention extends to a method of manufacture, with the body of the female connector being molded around latching sleeves which may have a lower melting point than the material making up the body itself.

19 Claims, 4 Drawing Sheets

ELECTRICAL CONNECTOR

BACKGROUND OF THE INVENTION

1. Field of the Invention

The present invention relates to electrical connectors and particularly although not exclusively to connectors for coupling a data cable to a hand-held computer terminal or bar code reader.

2. Description of the Related Art

Conventional electrical connectors for use with portable data entry terminals or bar code readers are notoriously susceptible to accidental damage. Such damage may frequently be caused when the user drops the device and breaks its fall by pulling hard on the data cable; under such circumstances, the connector is exposed to forces which are very substantially greater than the dead weight of the device.

Conventional connectors, such as the RS232 standard, are also not particularly convenient either to attach or to detach. The user must first carefully align the male and female connectors and then secure them in position by means of two screws, one on each side of the electrical contacts. In some versions of the RS232 connector these screws can be tightened manually, which is a rather fiddly operation; in others, it is necessary to use a small screwdriver.

SUMMARY OF THE INVENTION

It is an object of the present invention at least to alleviate the problems of the prior art.

It is a further object to provide an improved electrical connection which is both more convenient in use and which provides a high level of robustness against accidental mechanical damage.

FEATURES OF THE PRESENT INVENTION

The invention extends, in its most general form, to a male electrical connector, to a female electrical connector, to the combination of both connectors, and to a method of manufacturing a connector.

Specifically, according to one aspect of the present invention there is provided a female electrical connector for connection to a male connector, said female connector comprising:

(a) an electrical coupling portion;

(b) a body portion molded to said coupling portion and defining a female socket; and (c) a flexible latch member within said socket.

According to a second aspect there is provided a male electrical connector, said male connector comprising:

(a) a base portion;

(b) an electrical coupling portion mounted to said base portion; and (c) a male latch member extending outwardly from said base portion.

According to a third aspect there is provided an electrical connector arrangement, said arrangement comprising:

(1) a male connector having a base portion, a first electrical coupling portion mounted to said base portion and a male latch member extending outwardly from said base portion; and (2) a female connector having a second electrical coupling portion for electrical connection with said first electrical coupling, a body portion molded to said second electrical coupling and defining a female socket, and a flexible latch member within said socket for receiving and latching said male latch member as said male and female connectors are urged towards one another.

According to a final aspect there is provided a method of manufacturing an electrical connector comprising:

(a) providing an electrical coupling portion;

(b) holding a flexible latch portion on a former in a desired relationship with said coupling portion, (c) molding a plastics material body around said coupling portion and said latch portion; and (d) withdrawing said former.

Briefly stated, the male connector of the present invention includes a base portion, an electrical coupling portion and a male latch member which extends outwardly from the base portion. The male latch member may typically be one or more fixed latching posts each having one or more shoulders thereon which are arranged, in use, to latch behind one or more corresponding shoulders within the female electrical connector. The female connector itself comprises an electrical coupling portion, a body portion molded to the coupling portion and defining a female socket, and a flexible latch member within the socket. The flexible latch member itself defines the shoulder which in use is arranged to abut and to latch behind the corresponding shoulder on the male latch member.

Preferably, the female latch member comprises a flexible sleeve, ideally of nylon, which itself is made up of a plurality of longitudinally-extending latching fingers. In use, the male latch member or latch post passes between the fingers, with abutments or shoulders on the fingers latching into a reduced-diameter neck portion on the post. It would of course be equally possible for an upstanding portion on the post to latch into an appropriate depression or behind a shoulder on the female latch member.

The male and female electrical connectors are so called by virtue of the respective characteristics of the latching mechanism by which they are held together in use. The reference to "male" and "female" does not necessarily reflect the characteristics of the respective electrical coupling portions. In one embodiment, the male connector may include pins which, in use, are received within corresponding pin-sleeves on the female connector; these may, however, be reversed without affecting the male/female latching arrangements.

The female coupling portion is preferably of a plastics material such a nylon which is slightly flexible and resilient. Ideally, that material should be rather harder than the flexible material used for molding the body since it will not only wear better but can also be manufactured more precisely. The size of the female latching portion, and the size and respective angles of the shoulders on the male and female portions may be adjusted to achieve the desired latching and release characteristics. The force needed for release should be greater than that expected under conditions of normal use, but not so great that the connectors cannot be separated by pulling them apart manually.

The female latching member may be manufactured of a plastics material having a lower melting point than the molding material used for the body. To prevent the latching member from melting as the body is molded around it, the latching member may be held in position by a former having high thermal conductivity. Heat is then transferred away from the latching member so keeping its temperature during the over-molding process below its melting point.

BRIEF DESCRIPTION OF THE DRAWINGS

The foregoing objects and advantages of the present invention may be more readily understood by one skilled in the art with reference being had to the following detailed description of the preferred embodiment, taken in conjunction with the accompanying drawings, in which.

DETAILED DESCRIPTION OF THE PREFERRED EMBODIMENT

Figure 1:
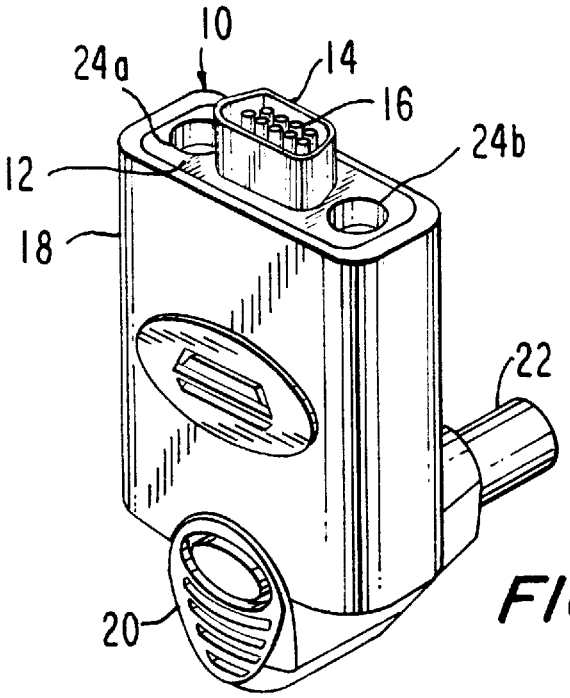
FIG. 1 is a perspective view of an electrical connector embodying the present invention.
Figure 2:
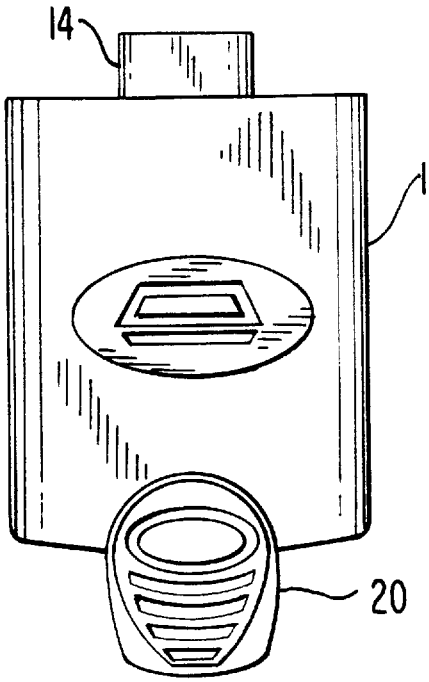
FIG. 2 is a view from the front of the electrical connector of FIG. 1.
Figure 3:
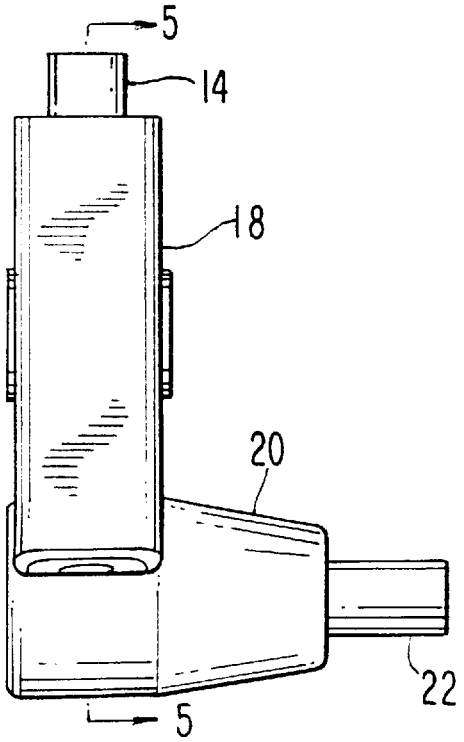
FIG. 3 is a view from the side of the electrical connector of FIG. 1.
Figure 4:
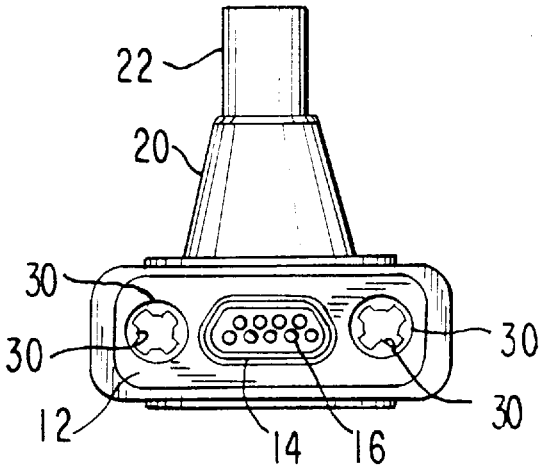
FIG. 4 is a top view of the electrical connector of FIG. 1.

An electrical connector according to the preferred embodiment of the present invention is shown schematically in FIGS. 1 to 4. The connector has a metal end portion generally indicated at 10 having a metal mounting plate 12 which includes an upstanding connector sleeve 14. Within the sleeve are a plurality of hollow upstanding pin-connector sleeves 16, each being arranged to receive an individual pin (not shown) from an associated connector.

Extending backwardly from the metal end portion 10, and molded around it, is a PVC body portion 18 at the base of which there is an extended boss 20 from which extends a data lead 22. The PVC body the boss and the outer surface of the data lead may be integrally molded for strength and ease of manufacture.

Further details will now be described with reference to the cross-section through the electrical connector, shown in FIG. 5. On either side of the connector sleeve 14 on the mounting plate 12 there are circular apertures, 25*a*,25*b*. These extend downwardly through the PVC body portion 18 as longitudinal bores 26*a*,26*b*. Immediately behind the mounting plate 12, and within these bores, are located respective first and second nylon sleeves 26*a*,26*b*. Each sleeve 26 is generally of hollow cylindrical shape and includes a cylindrical base portion 28 upstanding from which are four elongate slightly flexible fingers 30, the fingers being separated by slots 33 which are open at their upper end and closed at their lower by the base portion 28.

Each of the fingers 30 has an inwardly-directed portion about halfway along its length, with the four fingers together thereby providing a waist portion 32. On the interior of the waist portion, within the sleeve, the fingers define an angled guide portion 34 and, on the other side of the waist, a shoulder portion 36.

Electrical connections from the pin-connector sleeves 16 extend through to the interior of the body portion 18 to electrical couplings 38. These may be soldered or otherwise secured to the individual wires (not shown) within a data cable 40. The data cable 40 extends longitudinally down through the centre of the body portion, where it is held in place with a cable grip 42. From the grip, the cable passes down into the boss 20 and extends out of the electrical connector via the PVC-covered data lead 22.

Figure 5:
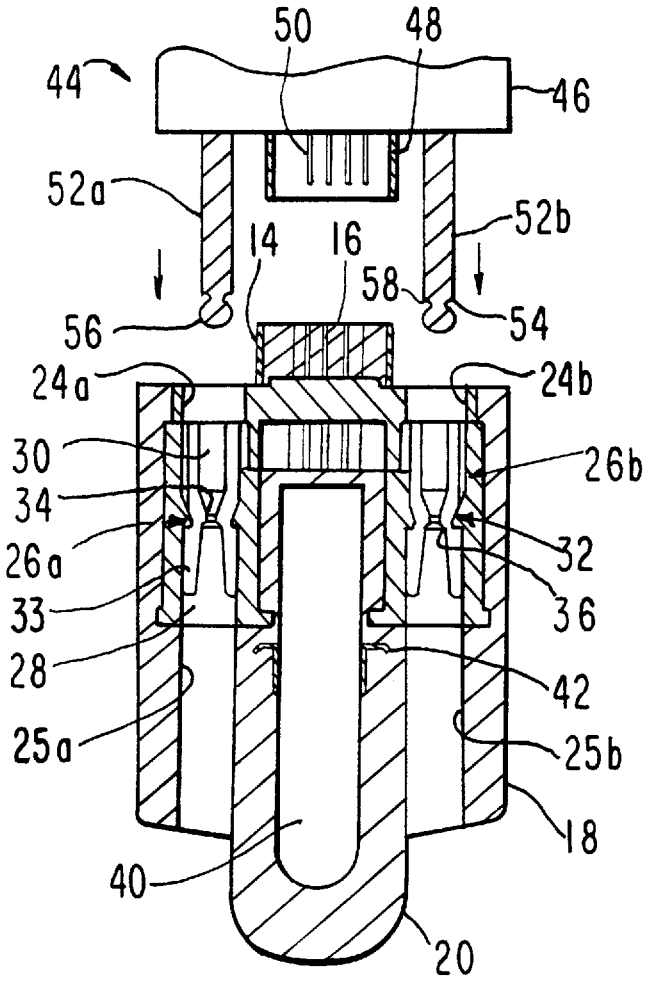
FIG. 5 is a section along the line 5—5 of FIG. 3 with an associated connector prior to connection.

The electrical connector of FIGS. 1 to 5 is arranged to couple with an associated connector illustrated schematically at 44 in FIG. 5. The associated connector has a base portion 46 upstanding from which is a connector sleeve 43 which is shaped to slide onto and to fit around the connector sleeve 14. As the sleeve 48 is pushed over the sleeve 14, pins 50 are inserted into the pin connector sleeves 16. On either side of the connector sleeve 48 are upstanding connector posts 52*a*,52*b*, each of which terminate in a neck 54 and a ball 56. As the connectors are moved towards each other, the connector posts 52*a*,52*b* are pushed downwardly into the nylon sleeves 26, causing the flexible fingers 30 to bend slightly apart. Eventually, the ball 56 passes the waist portion 32, and the fingers spring back, firmly latching the rod into position with the neck 54 firmly held by the shoulder 36 of the sleeve.

Once the posts are firmly latched into position, the coupling is secure and is resistant to a substantial level of mechanical shock. Since there are no screw threads, as in a conventional RS232 connector, there are fewer parts that are susceptible to damage. In addition, it is of course easier and cheaper to manufacture the associated connector 44, with its fixed posts, than it is to manufacture the more complex arrangement of threaded guide posts required for an RS232 connector.

The connector and the associated connector may be detached by pulling them firmly apart. The amount of force that is needed to separate them will depend of course on the characteristics of the nylon sleeves 26 and the posts 52. In particular, the amount of force required may be increased by increasing the angle of the shoulder 58 at the neck 54, and correspondingly increasing the angle of the shoulder 36 on the nylon sleeve 26. It will be understood that it is within the skill of an artisan in the field to select these angles, and the flexibility of the fingers, in order to achieve a separating force which is small enough to allow the connectors to be separated when desired, but not so small that they are liable to separate accidentally, for example in the event that the hand-held computer terminal or bar code reader is dropped and is caught by the data lead 22. It has been found in practice that the ideal release force ranges between 10 and 15 pounds weight.

A brief description will now be given of the way in which the device shown in FIGS. 1 to 5 is manufactured. First, electrical connections are made to the couplings 38 at the rear of the mounting plate 12, and the data cable 40 is held in position. Pre-prepared nylon sleeves 26*a*,26*b*, are also appropriately positioned behind the mounting plate, in line with the apertures 24*a*,24*b*. The sleeves are held in position by metal former posts which may be similar to the posts 52*a*,52*b* shown in FIG. 5. With all the elements held in place, the end portion and the sleeves are then over-molded with PVC to form the body portion 18, the boss 20 and the outer portion of the data lead 22. Once the PVC has solidified, the former posts are removed, leaving the nylon sleeves embedded within the body as shown in FIG. 5.

During the over-molding of the PVC body, a relatively high temperature has to be used, for example between 375° and 425° F. Depending upon the exact constitution of the nylon sleeves, this may be higher than the melting point of the nylon (382° to 460° F.). Even if the ambient temperature of the molten PVC does, however, rise above the melting point of the nylon sleeves, the sleeves always remain sufficiently cool not to melt by virtue of the heat that is extracted from them by the metal former posts. The former posts effectively act as a heat sink to dissipate heat from the sleeves, thus preventing them melting.

The body portion 18, although desirably moulded of PVC, may if required be molded of polyurethane or any other flexible plastic material. Likewise, the sleeves, although normally formed of nylon, may alternatively be formed of any other suitable spring-like material such as slightly more rigid plastic or even metal.

Figure 6:
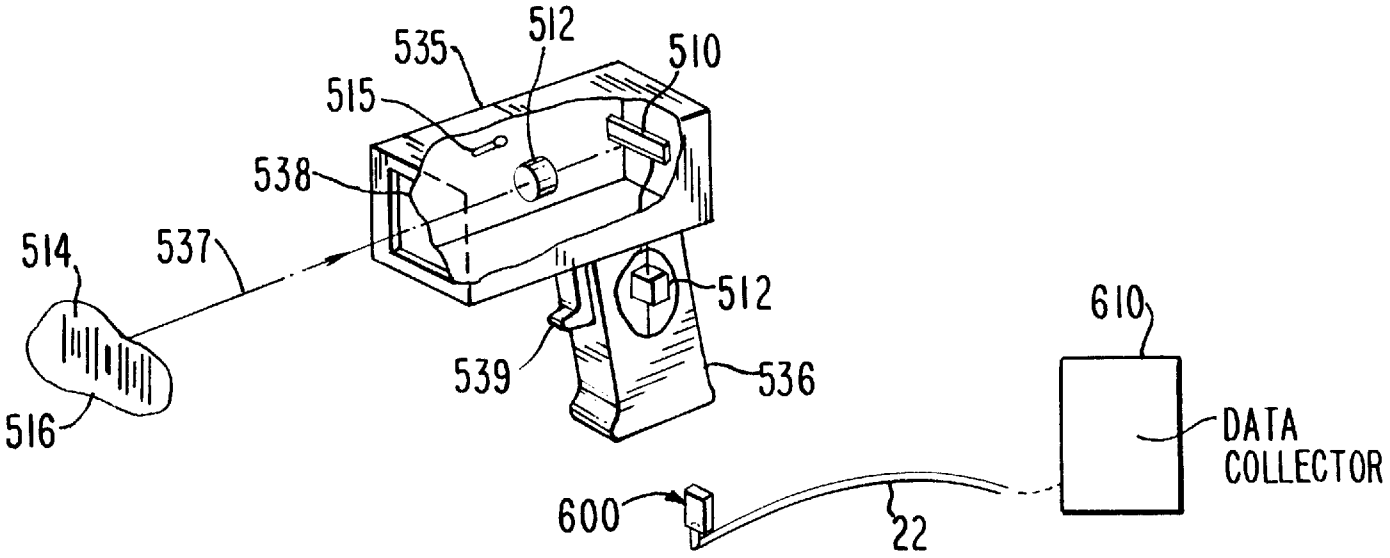
FIG. 6 shows an exemplary bar code reader for use with the electrical connector of FIGS. 1 to 5.

Turning now to FIG. 6, there is shown in schematic form an exemplary hand-held bar code reader which is suitable for use with the electrical connector illustrated in FIGS. 1 to 5. As shown in FIG. 6, the scanner comprises a main body 535 having a hand-graspable portion 536 which carries a trigger 539. Within the body 535 there is a laser or other light source 515 which is arranged to shine out through a window 538 to illuminate a surface 516 which carries a bar code 514 to be decoded. Light reflected from the bar code 514 passes back along a path 537 and through a lens 512 which images it onto a sensor 510. The readout from the sensor passes to a processor and memory unit 512. The processor decodes the information contained within the bar code 514. Electrical signals from the processor pass to an associated connector (not shown) on the base of the scanner, to which an electrical connector 600 as shown in FIGS. 1 to 5 may be connected. The signals then pass along the data lead 22 to a remote data collection unit 610 for further processing.

It will be understood that the electrical connector shown in FIGS. 1 to 5 may be useful in many other applications in addition to that illustrated specifically in FIG. 6. The connector may, in most general terms, be used to couple any two leads or electrical devices which require the transfer or interchange of data. In particular, the connector may be used in any application in which an RS232 connector may be used.

Without further analysis, the foregoing will so filly reveal the gist of the present invention that others can readily adapt to various applications without omitting features that, from the standpoint of prior art, fairly constitute essential characteristics of the generic or specific aspects of the invention and, therefore, such adaptations should be and are intended to be comprehended within the meaning and range of equivalents of the following claims.

We claim:

1. A female electrical connector for connection to a male connector having a pair of solid, cylindrical posts extending in mutual parallelism and terminating in a pair of enlarged post ends, said female connector comprising:

(a) an electrical coupling portion having a connector sleeve and a mounting plate defining two apertures;

(b) a body portion molded to said coupling portion and defining a pair of female sockets, said female sockets communicating with said apertures; and (c) a pair of flexible latch members within said sockets, said latch members including a pair of hollow, cylindrical latch sleeves, each of the latch sleeves having at least three elongated, flexible fingers symmetrically arranged about a respective longitudinal axis and having radially inwardly directed portions bounding a waist for engaging a respective post end at multiple locations about the respective axis and for holding the respective enlarged post end entirely within the respective latch sleeve.

2. A female electrical connector according to claim 1 wherein said female sockets are provided one on each side of said coupling portion.

3. A female electrical connector according to claim 1 wherein each said latch sleeve includes a base portion having said plurality of upstanding flexible fingers extending therefrom.

4. A female electrical connector according to claim 3 wherein said fingers include respective latching shoulder portions.

5. A female electrical connector according to claim 1 wherein said coupling portion is of metal.

6. A female electrical connector according to claim 1 wherein said body portion is of polyvinylchloride.

7. A female electrical connector according to claim 1 wherein each flexible latch member is of nylon.

8. A female electrical connector according to claim 1 wherein each body portion is moulded around said latch member.

9. A female electrical connector according to claim 8 wherein each latch member is of a material having a lower melting point than that of said body portion.

10. An electrical connector arrangement, said arrangement comprising:

(1) a male connector having a base portion, a first electrical coupling portion mounted to said base portion and a pair of male latch members extending outwardly from said base portion and having a pair of solid, cylindrical posts extending in mutual parallelism and terminating in a pair of enlarged post ends; and (2) a female connector heaving a second electrical coupling portion having a connector sleeve and a mounting plate defining two apertures for electrical connection with said first electrical coupling portion, a body portion molded to said second electrical coupling portion and defining a pair of female sockets, said female sockets communicating with said apertures, and a pair of flexible female latch members within said sockets for receiving and latching said male latch members as said male and female connectors are urged towards one another, said female latch members including a pair of hollow, cylindrical latch sleeves, each of the latch sleeves having at least three, elongated, flexible fingers symmetrically arranged about a respective longitudinal axis and having radially inwardly directed portions bounding a waist for engaging a respective post end at multiple locations about the respective axis and for holding the respective enlarged post end entirely within the respective sleeve.

11. An electrical connector arrangement according to claim 10 wherein said posts are disposed one on each side of said first electrical coupling portion.

12. An electrical connector arrangement according to claim 10 wherein each post has, near a said post end thereof, a first shoulder portion.

13. An electrical connector arrangement according to claim 12 wherein said first portion defines a reduced-diameter neck portion.

14. An electrical connector arrangement according to claim 12 wherein each sleeve has a second shoulder portion which latches each first shoulder portion of each post.

15. An electrical connector arrangement according to claim 10 in which said male connector and said female connector are separable by applying a sufficient releasing force.

16. An electrical connector arrangement according to claim 10 wherein said body portion is of polyvinylchloride.

17. An electrical connector arrangement according to claim 10 wherein each flexible latch member is of nylon.

18. An electrical connector arrangement according to claim 10 wherein said body portion is molded around said female latch members.

19. An electrical connector arrangement according to claim 10 wherein each female latch member is of a material having a lower melting point than that of said body portion.

* * * * *